US006146211A

United States Patent [19]

Okamoto et al.

[11] Patent Number: 6,146,211

[45] Date of Patent: Nov. 14, 2000

[54] TERMINAL

[75] Inventors: Kenichi Okamoto; Kazuhisa Ishizaki, both of Shizuoka, Japan

[73] Assignee: Yazaki Corporation, Tokyo, Japan

[21] Appl. No.: 09/432,607

[22] Filed: Nov. 3, 1999

[30] Foreign Application Priority Data

Nov. 9, 1998 [JP] Japan ..... 10-318064

[51] Int. Cl.[7] ..... H01R 13/04

[52] U.S. Cl. ..... 439/693; 439/825; 439/181

[58] Field of Search ..... 439/891, 825, 439/884, 693, 181, 875, 877, 865, 866

[56] References Cited

U.S. PATENT DOCUMENTS

| | | | |
|---|---|---|---|
| 2,537,370 | 1/1951 | Parnes | 173/361 |
| 3,716,820 | 2/1973 | Deakin | 339/147 |
| 3,893,743 | 7/1975 | Wallo | 339/183 |
| 3,950,070 | 4/1976 | Groft et al. | 339/217 |
| 4,037,319 | 7/1977 | Maloof | 29/629 |
| 4,335,930 | 6/1982 | Feldman | 339/183 |
| 4,790,763 | 12/1988 | Weber et al. | 439/65 |
| 4,818,237 | 4/1989 | Weber | 439/693 |
| 5,304,219 | 4/1994 | Chernoff et al. | 607/122 |
| 5,588,852 | 12/1996 | Puerner | 439/135 |
| 5,662,500 | 9/1997 | Yeah | 439/732 |
| 5,904,599 | 5/1999 | Miller et al. | 439/827 |

*Primary Examiner*—Paula Bradley
*Assistant Examiner*—Alexander Gilman
*Attorney, Agent, or Firm*—Sughrue, Mion, Zinn, Macpeak & Seas, PLLC

[57] ABSTRACT

A terminal 10 includes a terminal body 11, made of electrically-conductive metal, and a stopper body 13 made of an insulative resin. That portion of the terminal body 11, extending from its distal end 11*a* to its proximal portion 11*b*, is formed into a generally-cylindrical tubular shape, and a slit-like guide groove 11*c* is formed through this generally-cylindrical tubular portion, and extends along a length thereof. The stopper body 13 includes a generally-cylindrical connecting portion 13*a*, an insulating projected portion 13*b* of a generally conical shape, formed at a distal end of the connecting portion 13*a*, and a retaining ring portion 13*c* of a generally annular tubular shape formed at a proximal end of the connecting portion 13*a*. A guide ridge 13*d* is formed on the connecting portion 13*a* of the stopper body 13, and can be positioned relative to the guide groove 11*c* so as to be fitted in this guide groove, and with this construction, the generally-cylindrical connecting portion 13*a* of the stopper body 13, extending between the insulating projected portion 13*b* and the retaining ring portion 13*c*, can be fitted in the generally-cylindrical tubular portion of the terminal body 11 extending from the distal end 11*a* thereof to the proximal portion 11*b* thereof.

3 Claims, 6 Drawing Sheets

PRIOR ART

TERMINAL

BACKGROUND OF INVENTION

1. Field of the Invention

This invention relates to a terminal, such as a pin terminal, used in connectors for various electric equipments.

2. Related Art

FIGS. 7 and 8 show known pin terminals of the type described, respectively. The male pin terminal 1, shown in FIG. 7, includes a terminal body 2 formed by cutting an electrically-conductive metal rod into a predetermined shape (pin-shape). An insulating cap 3, made of an insulative resin, is mounted on a distal end portion 2*a* of the terminal body 2. The pin terminal 1 is adapted to be retained and held by a terminal retaining portion, formed on a connector housing (not shown), through a flange 2*b* formed on a proximal end portion of the terminal body 2. The insulating cap 3 prevents an electric shock during application of a large electric current.

The male pin terminal 5, shown in FIG. 8, includes a terminal body 6 formed by pressing an electrically-conductive e sheet (plate) into a generally cylindrical shape except a V-shaped conductor-clamping portion 6*a* at a proximal end thereof. A distal end portion 6*b* of the terminal body 6 is formed into a tapering (conical) shape, and an annular stopper ring 8 is put on the terminal body 6 from the distal end portion 6*b*, and then is fitted on a generally-annular, projected proximal portion 6*c* thereof through an E-ring 7. The pin terminal 5 is adapted to be retained and held in position by a terminal retaining portion, formed on a connector housing (not shown), through the stopper ring 8.

A technique analogous to those of the pin terminals 1 and 5 is disclosed in Japanese Patent Unexamined Publication Hei. 9-7685.

In the conventional pin terminal 1, however, the terminal body 2 is formed by the cutting operation, and therefore the production cost is high. And besides, since the insulating cap 3 is small in size, the setting by the use of a mounting jig and so on was difficult, so that the assembling efficiency was low.

In the conventional pin terminal 5, the stopper ring 8 is put on the terminal body 6 from the distal end portion 6*b*, and then is fitted on the projected proximal portion 6*c*, and thereafter the E-ring 7 is fitted into an annular recess 6*d* in the terminal body 6 by the use of a special tool. Therefore, much time and labor were required for the assembling operation, so that the cost was high. And besides, since the distal end portion 6*b* of the terminal body 6 has the tapering shape, a die can not be set inside the terminal body in the pressing operation, and therefore it was difficult to obtain the accurate dimensions, so that defective products were liable to develop. Furthermore, the distal end portion 6*b* of the terminal body 6 is not covered with an insulating cap or the like, and therefore if a person inadvertently touches the distal end portion 6*b* of the terminal body 6 during application of a large electric current, there has been a risk of an electric shock.

SUMMARY OF INVENTION

This invention has been made in order to solve the above problems, and an object of the invention is to provide a terminal which has a good assembling efficiency, and can be produced at low costs, and has an excellent safety.

According to a first aspect of the present invention, there is provided a terminal comprising a terminal body, which is made of electrically-conductive metal, and has a wire connecting portion formed at a proximal end thereof for connection to a wire, and a stopper body which is made of an insulative resin, and is fitted in the terminal body, the stopper body being adapted to be retained in a terminal retaining portion of a connector housing; provided in that portion of the terminal body, extending from its distal end to its proximal portion, is formed into a tubular shape; and a slit-like guide groove is formed through the tubular portion, and extends along a length thereof; and the stopper body includes a rod-like connecting portion, an insulating projected portion, formed at a distal end of the connecting portion, and a retaining ring portion formed at a proximal end of the connecting portion; and a guide ridge is formed on the connecting portion of the stopper body, and can be positioned relative to the slit-like guide groove in the terminal body so as to be fitted in the guide groove; the rod-like connecting portion of the stopper body, extending between the insulating projected portion and the retaining ring portion, can be fitted in the tubular portion of the terminal body, extending from the distal end thereof to the proximal portion thereof, through the guide groove and the guide ridge.

In this terminal, the guide ridge, formed on the rod-like connecting portion of the stopper body, is positioned relative to the slit-like guide groove, which is formed longitudinally through the tubular portion of the terminal body, extending from the distal end to the proximal portion, and is fitted in this guide groove. Therefore, the rod-like connecting portion of the stopper body, extending between the insulating projected portion and the retaining ring portion, is fitted into the tubular portion of the terminal body extending from the distal end to the proximal portion, and merely by this labor-saving operation, the terminal body and the stopper body can be easily assembled together, and therefore the production cost is low. And besides, since the rod-like connecting portion of the stopper body is fitted into the tubular portion of the terminal body extending from the distal end to the proximal portion, the terminal body is prevented from being crushed after the assembling operation is finished, and the connection of this terminal to a mating terminal can always be maintained in a good condition. Furthermore, the insulating projected portion of the stopper body projects outwardly from the distal end of the tubular portion of the terminal body, and therefore even if a person inadvertently touches the distal end of the terminal during application of a large electric current, there is no possibility of an electric shock, thus ensuring the excellent safety.

In the terminal of a second aspect of the present invention according to the first aspect of the present invention, the terminal body is shaped by pressing, and a retaining portion is formed integrally on the proximal portion of the terminal body, and the stopper body is formed by molding, and an elastic engagement portion, which can be releasably engaged with the retaining portion, is formed integrally on the retaining ring portion of the stopper body.

In this terminal, when shaping the terminal body by pressing, a conical portion (tapering portion) does not need to be formed at the distal end of the terminal body, and therefore when pressing the terminal body into a cylindrical tubular shape, a die can be put inside the terminal body so that the excellent pressing capability can be achieved, and therefore the terminal. body of high precision can be produced at a low cost. And besides, when the terminal body and the stopper body are assembled together, the two are easily locked to each other through the engagement of the retaining portion, formed integrally on the proximal portion of the terminal body, with the elastic engagement portion, formed integrally on the retaining ring portion of the stopper body, and will not be disengaged from each other.

In the terminal of a third aspect of the present invention of the second aspect of the present invention, a peripheral surface of the connecting portion of the stopper body serves as a detection portion for detecting an improper inner diameter of the tubular portion of the terminal body, extending from the distal end thereof to the proximal portion thereof, and an inner peripheral surface of the retaining ring portion of the stopper body , serves as a detection portion for detecting an improper outer diameter of the tubular portion of the terminal body extending from the distal end thereof to the proximal portion thereof .

In this terminal, when mounting the stopper body on the terminal body, improper inner and outer diameters of the tubular portion of the terminal body, extending from the distal end to the proximal portion, can be detected by the peripheral surface of the connecting portion of the stopper body and the inner peripheral surface of the retaining ring portion, respectively. Therefore, the mounting of defective. products, such as a crushed terminal body and an expanded terminal body, can be prevented, and the terminal of a high quality can be produced at a low cost.

BRIEF DESCRIPTION OF DRAWINGS

FIG. 3(*b*) is a cross-sectional view taken along the line X—X of FIG. 3(*a*).

DETAILED DESCRIPTION OF PREFERRED EMBODIMENTS

One preferred embodiment of the present invention will now be described with reference to the drawings.

Figure 1:
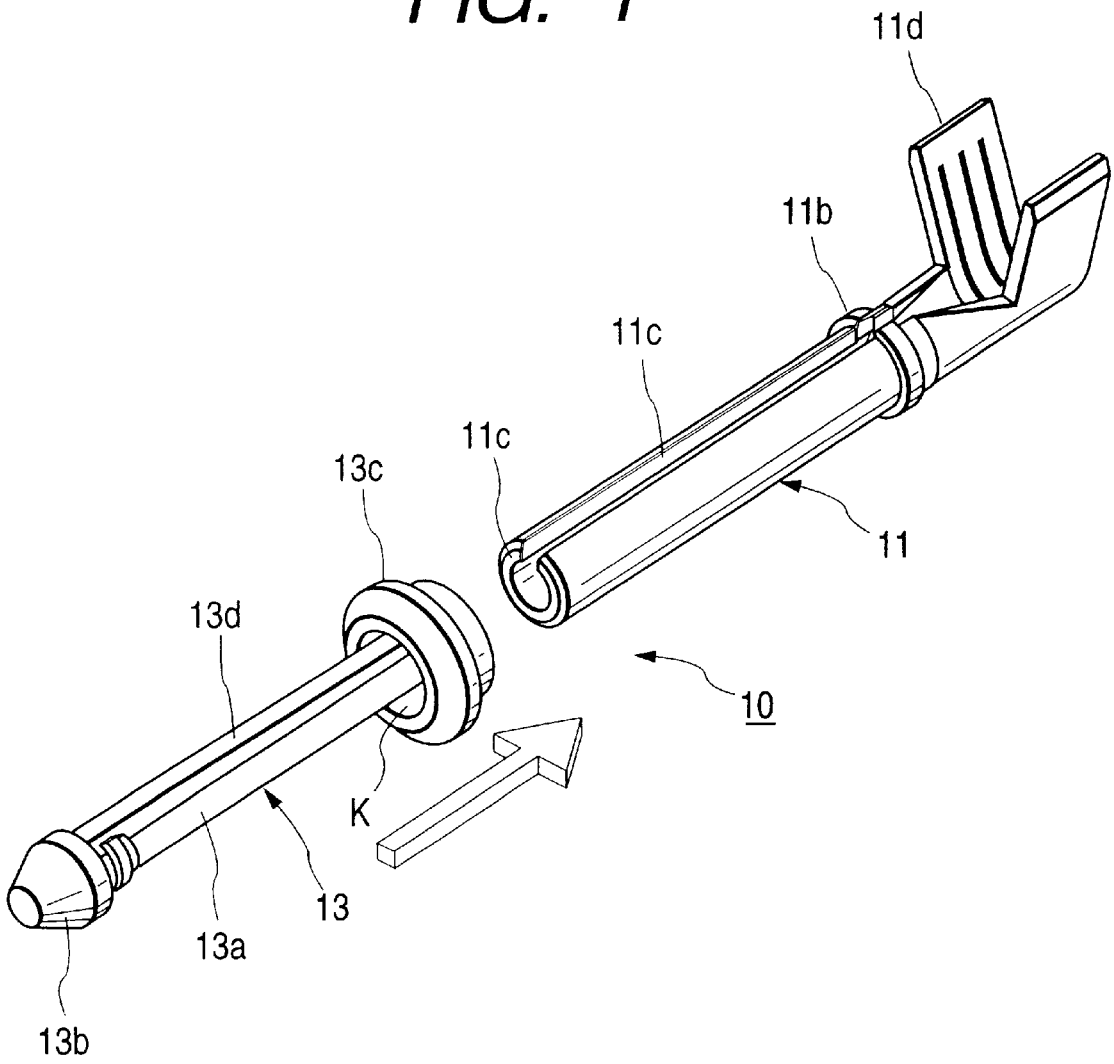
FIG. 1 is a perspective view of one preferred embodiment of a pin terminal of the present invention, showing a condition before it is assembled.
Figure 2:
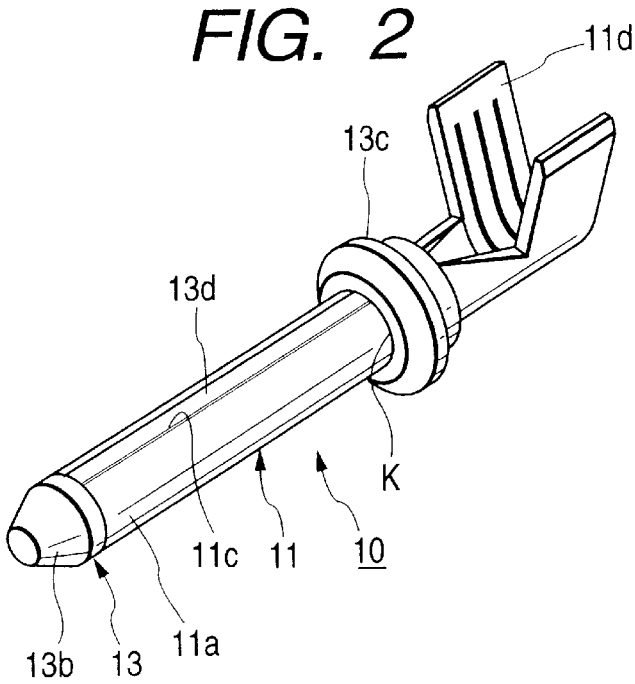
FIG. 2 is a perspective view of the terminal in its assembled condition.
Figure 3A:
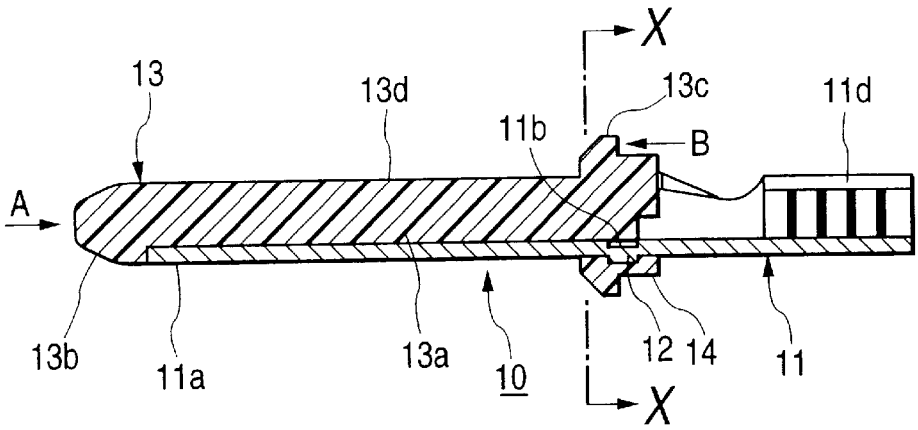
FIG. 3(*a*) is a longitudinal cross-sectional view of the pin terminal.
Figure 3B:
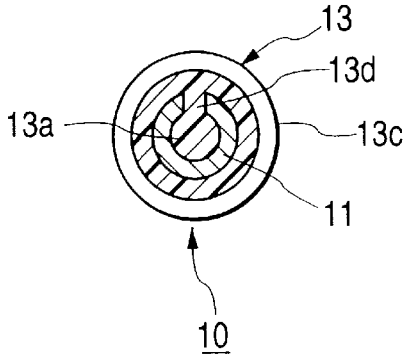
Figure 4A:
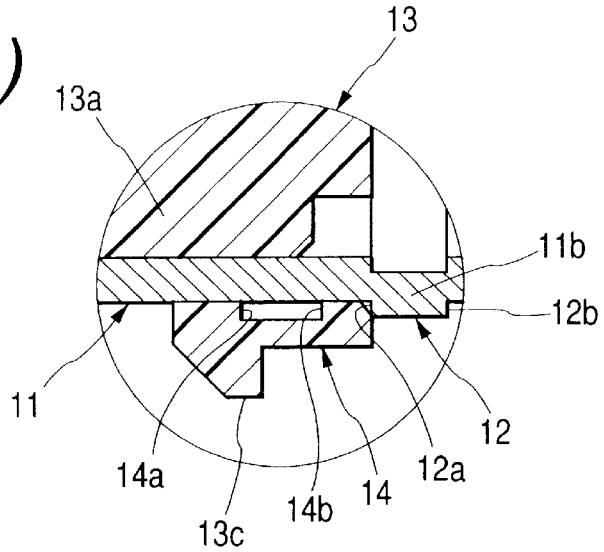
FIG. 4(*a*) is an enlarged cross-sectional view of important portions of a terminal body and a stopper body of the pin terminal, showing a condition before the two are locked together, and FIG. 4(*b*) is an enlarged cross-sectional view showing the above important portions during the locking operation, and FIG. 4(*c*) is an enlarged cross-sectional view of the above important portions, showing a condition in which the locking operation is completed.
Figure 4B:
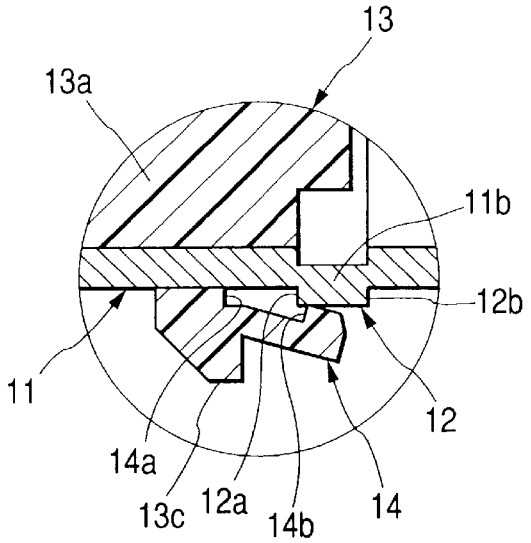
Figure 4C:
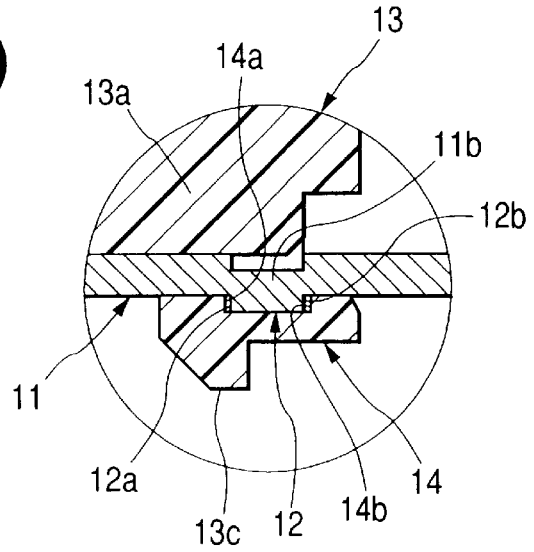
Figure 5A:
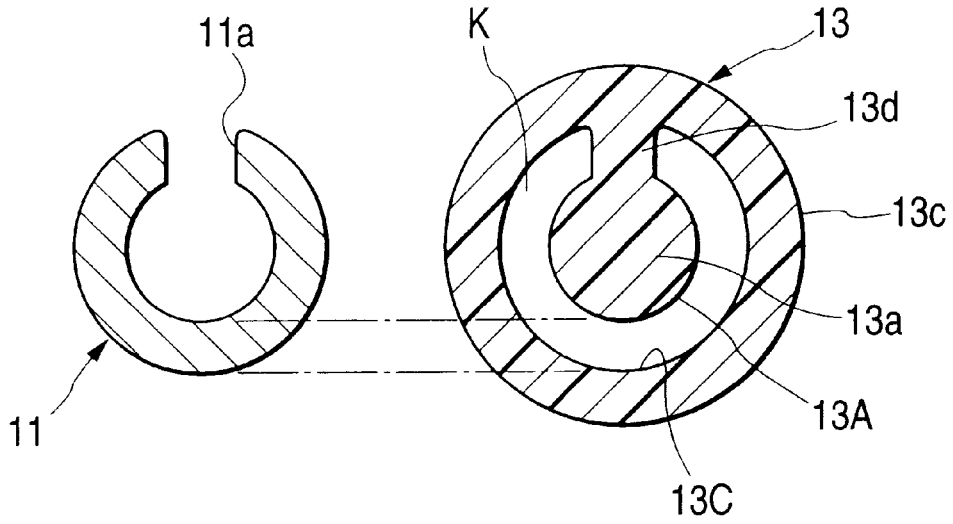
FIG. 5(*a*) is a cross-sectional view showing the positional relation between the terminal body and the stopper body, and FIG. 5(*b*) is a cross-sectional view of the terminal body having an improper inner diameter, and FIG. 5(*c*) is a cross-sectional view of the terminal body having an improper outer diameter.
Figure 5B:
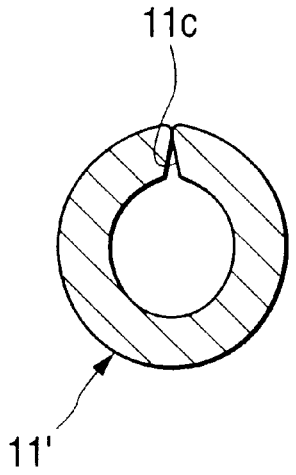
Figure 5C:
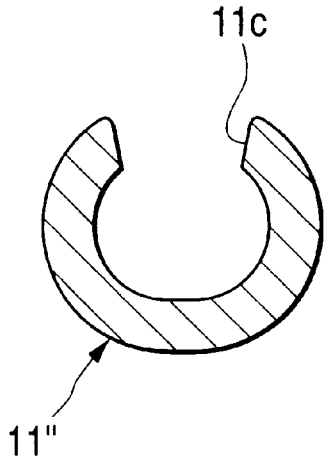
Figure 6:
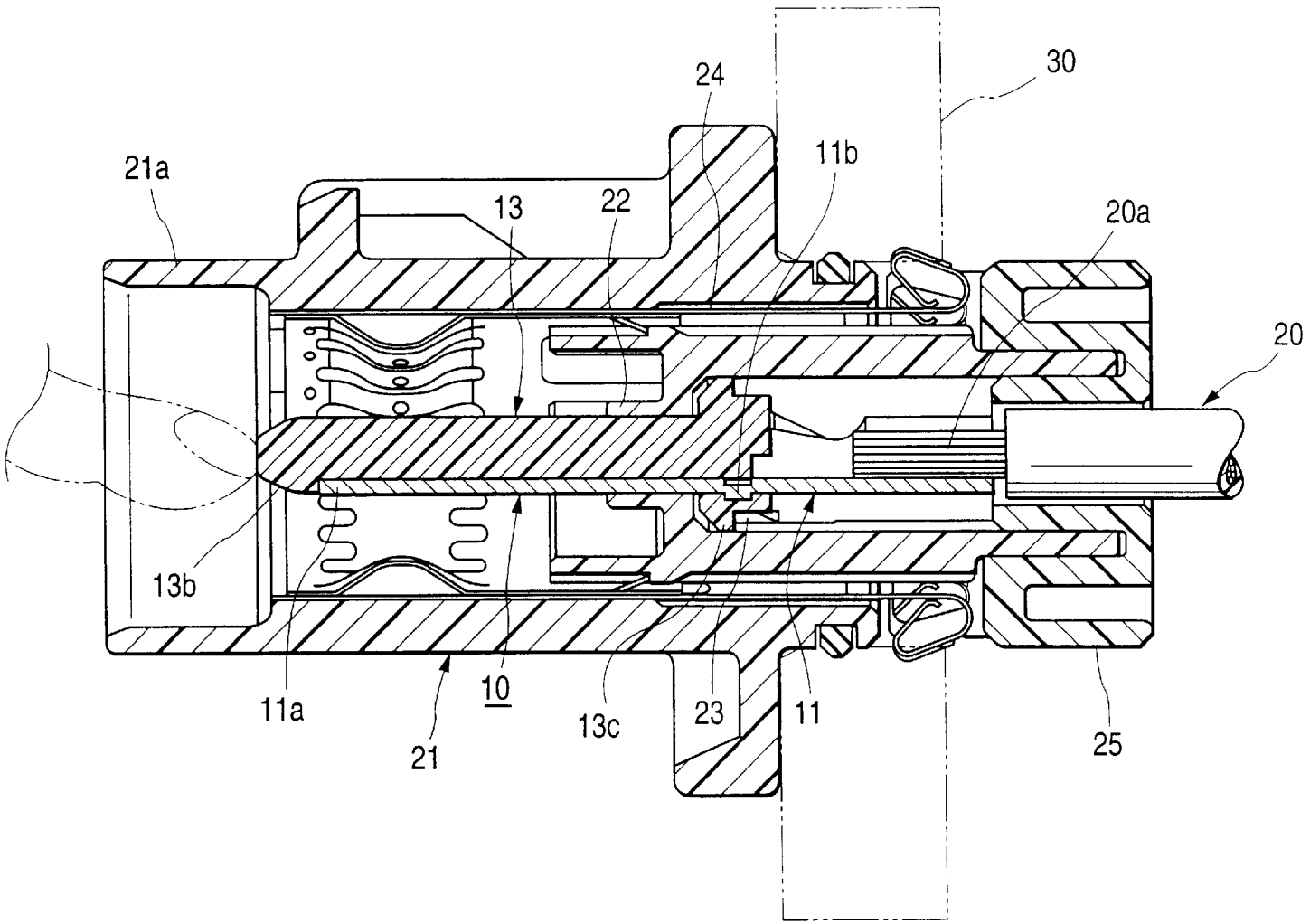
FIG. 6 is a longitudinal cross-sectional view showing the terminal mounted in a connector housing.
Figure 7:
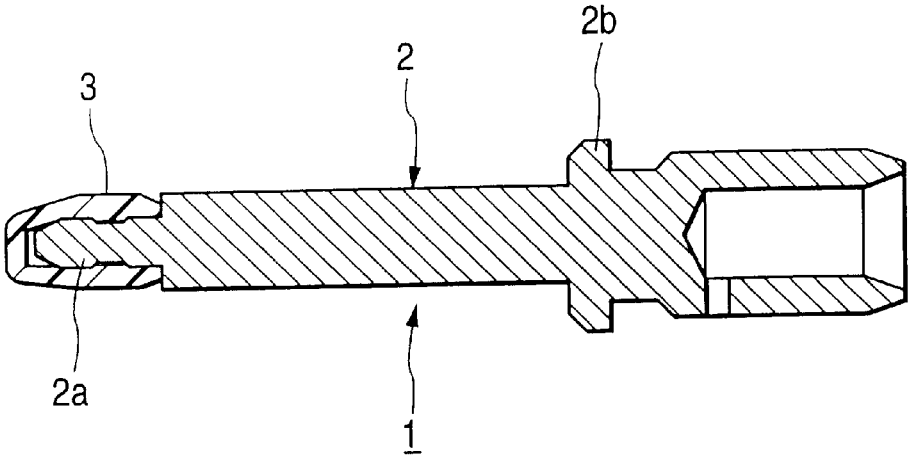
FIG. 7 is a cross-sectional view of a conventional pin terminal.
Figure 8:
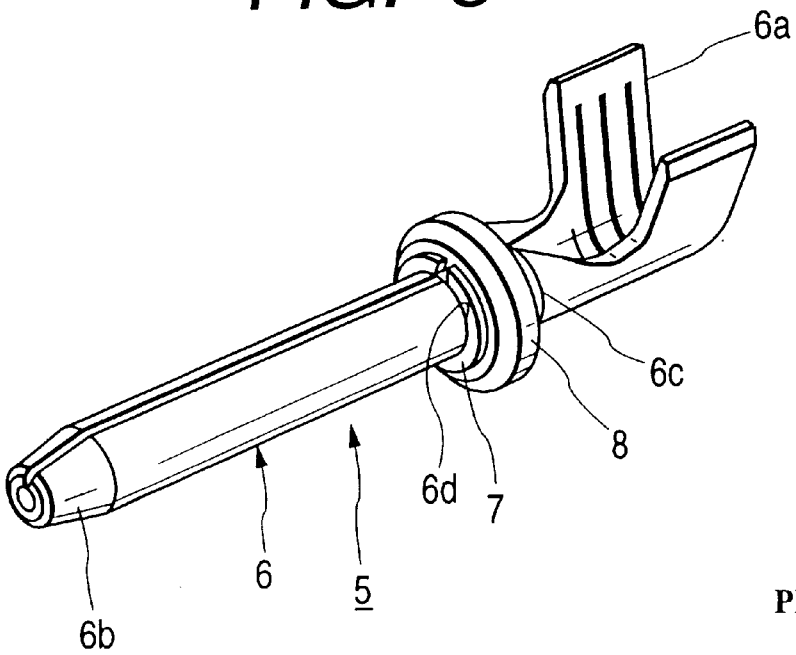
PRIOR ART FIG. 8
FIG. 8 is a perspective view of another conventional pin terminal.

FIG. 1 is a perspective view of one preferred embodiment of a terminal of the present invention, showing a condition before it is assembled, FIG. 2 is a perspective view of the terminal in its assembled condition, FIG. 3(*a*) is a longitudinal cross-sectional view of the terminal, FIG. 3(*b*) is a cross-sectional view taken along the line X—X of FIG. 3(*a*), FIG. 4(*a*) is an enlarged cross-sectional view of important portions of a terminal body and a stopper body of the terminal, showing a condition before the two are locked together, FIG. 4(*b*) is an enlarged cross-sectional view showing the above important portions during the locking operation, FIG. 4(*c*) is an enlarged cross-sectional view of the above important portions, showing a condition in which the locking operation is completed, FIG. 5(*a*) is a cross-sectional view showing the positional relation between the terminal body and the stopper body, FIG. 5(*b*) is a cross-sectional view of the terminal body having an improper inner diameter, FIG. 5(*c*) is a cross-sectional view of the terminal body having an improper outer diameter, and FIG. 6 is a longitudinal cross-sectional view showing the terminal mounted in a connector housing.

As shown in FIGS. 1 to 3 and 6, the male pin terminal 10 comprises the terminal body 11, made of electrically-conductive metal, and the stopper body 13 fitted in the terminal body 11, the stopper body 13 being made of an insulative resin. The terminal body 11 has a V-shaped conductor-clamping portion (wire connecting portion) 11*d* formed integrally at a proximal end thereof in a projected manner, and this conductor-clamping portion 11*d* is pressed to clamp a conductor 20*a* of a sheathed wire 20. The stopper body 13 is held and retained in a cylindrical terminal-retaining portion 22 of a connector housing 21 made of a synthetic resin.

That portion of the terminal body 11, extending from its distal end 11*a* to its proximal portion 11*b*, is formed by pressing into a generally cylindrical tubular shape, and a slit-like guide groove 11*c* is formed through an upper portion of this body portion, and extends along the length thereof. The proximal portion 11*b*, formed integrally with the terminal body 11, is stepped to project radially outwardly from the terminal body 11, and as shown in FIGS. 3(*a*), 4(*a*), 4(*b*) and 4(*c*), the proximal portion 11*b* defines a retaining pawl (retaining portion) 12 having front and rear retaining surfaces 12*a* and 12*b*.

The stopper body 13 is molded into an integral construction including a connecting portion 13*a* of a generally cylindrical shape, an insulating projected portion 13*b* of a generally conical shape, formed at a distal end of the connecting portion 13*a*, and a retaining ring portion 13*c* of a generally annular tubular shape formed at a proximal end of the connecting portion 13*a*. A guide ridge 13*d* is formed integrally on the upper side of the connecting portion 13*a* in a projected manner, and this guide ridge 13*d* is positioned relative to the slit-like guide groove 11*c* in the terminal body 11, and is fitted therein.

As shown in FIG. 5(*a*), the connecting portion 13*a* of the stopper body 13 has such a diameter as to be snugly fitted in the generally-cylindrical portion of the terminal body 11 extending from its distal end 11*a* to its proximal portion 11*b*. With this construction, through the guide groove 11*c* and the guide ridge 13*d*, the generally-cylindrical connecting portion 13*a* of the stopper body 13, extending between the insulating projected portion 13*b* and the retaining ring portion 13*c*, can be fitted into the generally-cylindrical tubular portion of the terminal body 11 extending from the distal end 11*a* to the proximal portion 11*b*. As shown in FIG. 5(*a*), a peripheral surface 13A of the connecting portion 13*a* of the stopper body 13 serves as a detection portion for detecting an improper inner diameter of the generally-cylindrical tubular portion of the terminal body 11 extending from the distal end 11*a* to the proximal portion 11*b*. A defective (improper inner-diameter) terminal body 11' (see FIG. 5(*b*)), crushed at a generally-cylindrical portion thereof between a distal end to a proximal portion, can be detected by the peripheral surface 13A of the connecting portion 13*a* of the stopper body 13 before the assembling operation is completed. And besides, an inner peripheral surface 13C of the retaining ring portion 13*c* of the stopper body 13 serves as a detection portion for detecting an improper outer diameter of the generally-cylindrical tubular portion of the terminal body 11 extending from the distal end 11*a* to the proximal portion 11*b*. A detective (improper outer-diameter) terminal body 11" (see FIG. 5(*b*)), expanded at a generally-cylindrical tubular portion thereof between a distal end to a proximal portion, can be detected by the inner peripheral surface 13C of the retaining ring portion 13*c* of the stopper body 13 before the assembling operation is completed. As shown in FIG. 5(*a*), the guide ridge 13*d* on the connecting portion 13*a* of the stopper body 13 is formed integrally with the inner peripheral surface 13C of the retaining ring portion 13*c*, and the stopper body 13 is inserted and fitted into the terminal body 11 through a space K of a C-shaped cross-section formed by the inner peripheral surface 13C and the opposite sides of the guide ridge 13*d*.

An elastic engagement arm (engagement portion) 14 of a generally U-shaped cross-section is formed integrally on that portion of the retaining ring portion 13*c* of the stopper body 13 to be opposed to the retaining pawl 12, and this engagement arm 14 is releasably engaged with the retaining pawl 12. The engagement arm 14 has front and rear engagement surfaces 14*a* and 14*b* which are to be opposed respectively to the front and rear retaining surfaces 12*a* and 12*b* of the retaining pawl 12.

As shown in FIG. 6, the retaining ring portion 13*c* of the pin terminal 10, inserted in the cylindrical terminal retaining portion 22 of the connector housing 21 of a connector for an electric equipment, is retained by a lance (elastic retaining arm) 23 against withdrawal. A mating connector (not shown), having a shield wire, is adapted to be fitted into a hood portion 21*a* formed at a front end of the connector housing 21. Within the connector housing 21, shield terminals 24 for contact with a shield shell (not shown), connected to a braid wire of the above-mentioned shield cable, are arranged around the pin terminal 10. The connector housing 21 is mounted on a casing 30 (made of electrically-conductive metal) of the electric equipment, and the wire 20 is supported by a rear holder 25.

In the pin terminal 10 of the above embodiment, for mounting the stopper body 13 on the terminal body 11, the generally-cylindrical connecting portion 13*a* of the stopper body 13, extending between the insulating projected portion 13*b* and the retaining ring portion 13*c*, is fitted into the generally-cylindrical tubular portion of the terminal body 11 extending from the distal end 11*a* to the proximal portion 11*b*, so that the guide ridge 13*d* on the connecting portion 13*a* of the stopper body 13 is positioned relative to the guide groove 11*c* in the terminal body 11, and is fitted therein. In this fitting operation, the elastic engagement arm 14, formed integrally with the retaining ring portion 13*c* of the stopper body 13, is elastically deformed, and then is engaged with the retaining pawl 12 formed integrally with the proximal portion 11*b* of the terminal body 11 as shown in FIGS. 4(*a*) to 4(*c*). Thus, the assembled condition of the terminal body 11 and the stopper body 13 can be easily locked, and even upon application of external forces A and B, shown in FIG. 3(*a*), the terminal body 11 and the stopper body 13 can be positively prevented from being disengaged from each other.

When shaping the terminal body 11 of this pin terminal 10 by pressing, a conical portion as in the conventional construction does not need to be formed at the distal end of the terminal body 11, and therefore when pressing the terminal body 11 into a cylindrical tubular shape, a die can be put inside the terminal body so that the pressing capability can be enhanced, and therefore the terminal body 11 of high precision can be produced at a low cost. When mounting the stopper body 13 on the thus shaped terminal body 11, improper inner and outer diameters of the generally-cylindrical tubular portion of the terminal body 11, extending from the distal end 11*a* to the proximal portion 11*b*, can be detected by the peripheral surface 13A of the connecting portion 13*a* of the stopper body 13 and the inner peripheral surface 13C of the retaining ring portion 13*c*, respectively. Therefore, the mounting of defective products, such as the crushed terminal body 11' (shown in FIG. 5(*b*)) and the expanded terminal body 11" (shown in FIG. 5(*c*)), can be positively prevented, and the pin terminal 10 of a high quality can be assembled and produced at a low cost.

The generally-cylindrical connecting portion 13*a* of the stopper body 13, extending between the insulating projected portion 13*b* and the retaining ring portion 13*c*, is fitted into the generally-cylindrical tubular portion of the terminal body 11 extending from the distal end 11*a* to the proximal portion 11*b*, and merely by this labor-saving operation, the terminal body 11 and the stopper body 13 can be easily assembled together. Therefore, the efficiency of the assembling operation of the pin terminal 10 can be enhanced, and besides the pin terminal 10 can be produced at a low cost.

Since the generally-cylindrical connecting portion 13*a* of the stopper body 13 is fitted into the generally-cylindrical tubular portion of the terminal body 11 extending from the distal end 11*a* to the proximal portion 11*b*, the terminal body 11 is positively prevented from being crushed after the assembling operation is finished, and the connection of this terminal to a mating female terminal can always be maintained in a good condition.

And besides, when the pin terminal 10 is set in the connector housing 21, the insulating projected portion 13*b* of the stopper body 13 projects outwardly from the distal end 11*a* of the generally-cylindrical tubular portion of the terminal body 11 of the pin terminal 10 as shown in FIG. 6, and therefore even if a person inadvertently touches the distal end of the pin terminal 10 during application of a large electric current when the connector housing 21 is used in a circuit or the like, there is no possibility of an electric shock, thus further enhancing the safety.

In the above embodiment, although the terminal in the form of a pin terminal has been described, the invention can be applied to a terminal of any other shape than such a pin-like shape. Although that portion of the terminal body, extending from its distal end to its proximal portion, is formed into a generally-cylindrical tubular shape while the stopper body to be fitted into this portion, is formed into a generally cylindrical shape, these portions are not limited to a cylindrical tubular shape and a cylindrical shape, respectively, and that portion of the terminal body, extending from the distal end to the proximal portion, can be formed, for example, into a generally-triangular tubular shape or a generally-square tubular shape while the stopper body can be formed, for example, into a generally-triangular cross-section or a generally-square cross-section.

As described above, in the present invention, the guide ridge, formed on the rod-like connecting portion of the stopper body, is positioned relative to the slit-like guide groove, which is formed longitudinally through the tubular portion of the terminal body, extending from the distal end to the proximal portion, and is fitted in this guide groove. Therefore, the rod-like connecting portion of the stopper body, extending between the insulating projected portion and the retaining ring portion, is fitted into the tubular portion of the terminal body extending from the distal end to the proximal portion, and merely by this labor-saving operation, the terminal body and the stopper body can be easily assembled together. Therefore, the efficiency of the terminal-assembling operation can be enhanced, and the terminal can be produced at a low cost. And besides, since the rod-like connecting portion of the stopper body is fitted into the tubular portion of the terminal body extending from the distal end to the proximal portion, the terminal body is positively prevented from being crushed after the assembling operation is finished, and the connection of this terminal to a mating terminal can always be maintained in a good condition. Furthermore, the insulating projected portion of the stopper body projects outwardly from the distal end of the tubular portion of the terminal body, and therefore even if a person inadvertently touches the distal end of the terminal during application of a large electric current, there is no possibility of an electric shock, thus enhancing the safety. In the present invention, when shaping the terminal body by pressing, a conical portion does not need to be formed at the distal end of the terminal body, and therefore when pressing the terminal body into a cylindrical tubular shape, a die can be put inside the terminal body so that the pressing capability can be enhanced, and therefore the terminal body of high precision can be produced at a low cost. And besides, when the terminal body and the stopper body are assembled together, the two are easily locked to each other through the engagement of the retaining portion, formed integrally on the proximal portion of the terminal body, with the elastic engagement portion, formed integrally on the retaining ring portion of the stopper body, and the terminal body and the stopper body are positively prevented from being disengaged from each other.

In the present invention, when mounting the stopper body on the terminal body, improper inner and outer diameters of the tubular portion of the terminal body, extending from the distal end to the proximal portion, can be detected by the peripheral surface of the connecting portion of the stopper body and the inner peripheral surface of the retaining ring portion, respectively. Therefore, the mounting of defective products, such as a crushed terminal body and an expanded terminal body, can be prevented, and the terminal of a high quality can be assembled at a low cost.

What is claimed is:

1. A terminal comprising:

a terminal body made of electrically-conductive metal, and having a wire connecting portion formed at a proximal end thereof for connection to a wire, said terminal body, extending from its distal end to its proximal portion, formed into a tubular shape;

a stopper body made of an insulative resin, and fitted in said terminal body, said stopper body being adapted to be retained in a terminal retaining portion of a connector housing, said stopper body including:

a rod-like connecting portion;

an insulating projected portion, formed at a distal end of said connecting portion;

a retaining ring portion formed at a proximal end of said connecting portion;

a slit-like guide groove formed through said tubular portion, and extending along a length of the terminal body; and a guide ridge formed on said connecting portion of said stopper body, and positioned relative to said slit-like guide groove in said terminal body so as to be fitted in said guide groove, wherein said rod-like connecting portion of said stopper body, extending between said insulating projected portion and said retaining ring portion, can be fitted in said tubular portion of said terminal body, extending from the distal end thereof to the proximal portion thereof, through said guide groove and said guide ridge.

2. A terminal according to claim 1, in which said terminal body is shaped by pressing, and a retaining portion is formed integrally on said proximal portion of said terminal body, and said stopper body is formed by molding, and an elastic engagement portion, which can be releasably engaged with said retaining portion, is formed integrally on said retaining ring portion of said stopper body.

3. A terminal according to claim 2, in which a peripheral surface of said connecting portion of said stopper body serves as a detection portion for detecting an improper inner diameter of said tubular portion of said terminal body, extending from the distal end thereof to the proximal portion thereof, and an inner peripheral surface of said retaining ring portion of said stopper body, serves as a detection portion for detecting an improper outer diameter of said tubular portion of said terminal body extending from the distal end thereof to the proximal portion thereof.

* * * * *